United States Patent [19]

Marzik et al.

[11] Patent Number: 4,933,003

[45] Date of Patent: Jun. 12, 1990

[54] METAL ALLOY FORMATION BY REDUCTION OF POLYHETEROMETALLIC COMPLEXES

[75] Inventors: James V. Marzik, Nashua, N.H.; Louis G. Carreiro, Westport; Geoffrey Davies, Boston, both of Mass.

[73] Assignees: The United States of America as represented by the Secretary of the Army, Washington, D.C.; Northeastern University, Boston, Mass.

[21] Appl. No.: 382,826

[22] Filed: Jul. 18, 1989

[51] Int. Cl.[5] ..... B22F 9/30

[52] U.S. Cl. ..... 75/362

[58] Field of Search ..... 75/0.5 B

[56] References Cited

U.S. PATENT DOCUMENTS

| | | | |
|---|---|---|---|
| 3,449,115 | 6/1969 | Galmiche et al. | 75/0.5 B |
| 3,909,247 | 9/1975 | Pâris et al. | 403/364 |
| 4,111,686 | 9/1978 | Pâris et al. | 75/0.5 A |
| 4,537,624 | 8/1985 | Tenhover et al. | 75/0.5 B |
| 4,537,625 | 8/1985 | Tenhover et al. | 75/0.5 B |
| 4,585,617 | 4/1986 | Tenhover et al. | 75/0.5 B |
| 4,659,373 | 4/1987 | Bogdanovi | 75/0.5 B |

FOREIGN PATENT DOCUMENTS

| | | | |
|---|---|---|---|
| 816398 | 7/1959 | United Kingdom | 75/0.5 B |

OTHER PUBLICATIONS

J. V. Marzik, L. G. Carreiro and G. Davies, "Cu-Ni Alloy Formation By Reduction in Hydrogen of a Polyheterometallic Complex", J. Mat. Sci. Lett. 7 (1988), 833-835.

G. Davies, M. A. El-Sayed, and A. El-Toukhy, "Transmetalation of Tetranuclear Copper Complexes . . . ", Inorg. Chem. 25 (1986) 2269-2271.

A. El-Toukhy, G.-Z. Cai, G. Davies, T. R. Gilbert, K. D. Onan and M. Veidis, "Transmetalation Reactions of Tetranuclear . . . ", J. Amer. Chem. Soc. 106 (1984) 4596.

G. Davies, M. A. El-Sayed and A. El-Toukhy, "Transmetalation: A New Route To Heteropolymetallic Molecules and Materials", Comm. Inorg. Chem. (1989) Vi, No. 5,203-220.

A. Abu-Raqabah, G. Davies, M. A. El-Sayed, A. El--Toukhy and M. Henary, "Limits of Direct Transmetalation . . . ", Inorg. Chem. (1989) 28, 1156-1161.

M. Chen, C-T. Cheng and C-T. Yeh, "Determination of the Surface Composition of Copper-Nickel Alloy Powders; . . . ", Jour. of Catalysis, (1985) 95, 346-352.

J. L. Marignier, J. Belloni, M. O. Delcourt and J. P. Chevalier, "Microaggregates of Non-Noble Metals and Bimetallic Alloys . . . ", Nature 317, 344-345 (1985).

Cheetam et al., "On the Low Temperature Synthesis of Alloys by . . . ", J. Less-Common Met. 116 (1), pp. 43-50, Feb. 1, 1986.

*Primary Examiner*—John F. Niebling
*Assistant Examiner*—David W. Schumaker
*Attorney, Agent, or Firm*—Richard J. Donahue

[57] ABSTRACT

A method for forming a single-phase, homogeneous and high surface area metal alloy by reducing a polyheterometallic complex at a low temperature in hydrogen-containing gas.

4 Claims, No Drawings

METAL ALLOY FORMATION BY REDUCTION OF POLYHETEROMETALLIC COMPLEXES

STATEMENT OF GOVERNMENT INTEREST

The invention described herein may be manufactured, used and licensed by or for the Government for Governmental purposes without the payment to us of any royalty thereon.

BACKGROUND OF THE INVENTION

The present invention concerns the formation of compositionally and morphologically uniform metal alloys and catalysts at low temperature.

Metal alloys, such as copper-nickel (Cu-Ni), are well established as catalysts for a number of chemical processes. In hydrogenation reactions, alloy composition is known to affect significantly both catalyst activity and selectivity.

Gu-Ni catalysts can be prepared by a number of standard metallurgical and powder metallurgical techniques. Alloy formation in the Cu-Ni system is an endothermic process and alloys tend to exhibit compositional inhomogeneities in the form of local regions of relatively pure copper and pure nickel. A long careful annealing treatment is generally required to reach equilibrium and obtain single-phase homogeneous alloys. Techniques which tend to minimize inhomogeneities with a minimum of processing are therefore of great interest.

In any catalyst a high surface area is generally desirable and usually leads to high catalyst activity. Low temperature decomposition of inorganic or organometallic precursors is a potential route to high surface area alloys. Because of the endothermic nature of the Cu-Ni system, formation of single-phase homogeneous alloys may present a problem.

In a study of Cu-Ni alloy formation via the hydrogen reduction of metal carbonate precursors it was reported that fairly homogeneous alloys were obtained, but it was not clear that these were completely single phase. As a further consideration, the reported critical temperature for single-phase Cu-Ni alloy formation is 320° C. Thus, the decomposition temperature of the precursors would be expected to affect the homogeneity and extent of single-phase alloy formation.

It is therefore the principal object of the present invention to provide a method for forming single-phase metal alloys of high surface area at low temperatures.

SUMMARY OF THE INVENTION

In accordance with the present invention, single-phase homogeneous metal alloys of high surface area are formed at low temperature by the reduction of a polyheterometallic complex in hydrogen.

DETAILED DESCRIPTION OF THE INVENTION

Three systems were chosen as precursors for Cu-Ni alloys via hydrogen reduction, and were compared regarding the extent of alloy formation, homogeneity and morphology of the reduced product. The systems chosen for study were a copper(II) nitrate/nickel(II) nitrate mixture (precursor 1), a copper(II) chloride/-nickel(II) chloride mixture (precursor 2) and a heterometallic complex of formula $(\mu_4-0)N_4Cu_3NiCl_6.H_2O$ (precursor 3) where N is N,N-diethylnicotinamide. Each of the precursor systems contained a 3:1 atomic ratio of copper to nickel. The heterometallic complex was prepared by the transmetallation reaction $$(\mu_4-0)N_4Cu_4Cl_6+Ni(NS)_2\rightarrow(\mu_4-0)N_4Cu_3NiCl_6.+Cu(NS)_2$$

where NS is S-methyl isopropylidenehydrazinecarbodithioate. The Cu-Ni complex has the same core structure as the parent polynuclear copper complex, and is quite stable, with a shelf life of at least several months.

The reduction of the precursors was carried out in a Dupont Model 1090 thermogravimetric analysis (TGA) apparatus. The samples (25 mg aliquots) were heated in 85%:15% Ar:$H_2$ (flow rate 100 ml $min^{-1}$) to 650° C. at a rate of 60° $Ch^{-1}$. The change in weight as a function of temperature was recorded, and the temperature of complete reduction to metal was determined for each precursor. The extend of alloy formation in the reduction products was measured by X-ray diffraction. Patterns were obtained with a Philips diffractometer using monochromated high intensity Cu-K$\alpha_1$ radiation ($\lambda$=0.15405 nm). Morphology and chemical homogeneity were determined with a JEOL JXA-840 scanning electron microscope (SEM) equipped with two JEOL wavelength dispersive spectrometers (WDS), a Tractor Northern energy dispersive spectrometer (EDS) and a Tracor Northern model 5500/5600 X-ray and image analyser.

Temperatures required for the complete reduction of the precursors in hydrogen were determined by TGA, and are shown in the following Table 1.

TABLE 1

| PRECURSOR | DECOMPOSITION TEMPERATURE (°C.) |
|---|---|
| (Cu, Ni) nitrate | 248 |
| (Cu, Ni) chloride | 459 |
| Cu—Ni complex (precursor 3) | 370 |

The nitrates were completely reduced at the lowest temperature (248° C.), the chlorides at the highest temperature (459° C.), and the Cu-Ni complex reduced at an intermediate temperature (370° C.).

X-ray diffraction patterns of the reduction products were taken and observed. The reduction of the nitrate precursor produced pure copper and pure nickel metal with no indication of alloy formation seen in its X-ray diffraction pattern. This is consistent with the decomposition temperature of the nitrates (248° C.), which is below the critical temperature for alloy formation (320° C.) discussed earlier. Thus, alloy formation seems to be precluded with nitrate precursors under our experimental conditions.

The X-ray diffraction results were consistent with X-ray compositional mapping data collected in the SEM with an EDS spectrometer. The X-ray dot maps indicated that copper was largely segregated from nickel.

The reduction of the metal chloride precursors resulted in partial alloy formation according to the X-ray diffraction data. However the appearance of shoulders on the diffraction peaks indicated that a single phase was not obtained. This is consistent with X-ray compositional data, which clearly indicate compositional inhomogeneities. Partial alloy formation is consistent with the decomposition temperature of the chlorides (459° C.), which is above the critical temperature for alloy formation. The observed compositional inhomogeneities and incomplete phase formation seem to indicate that either additional processing steps or a different precursor system is required for the formation of single-phase alloys.

The reduction of the Cu-Ni complex (precursor 3) resulted in single-phase alloy formation, as seen in the related X-ray diffraction pattern. This is consistent with the decomposition temperature of the precursor (370° C.) which is above the critical temperature for alloy formation and is also consistent with X-ray compositional mapping results, which indicate complete homogeneity of copper and nickel. Thus, it seems that homogeneity of copper and nickel on a molecular level in the precursor facilitates single-phase homogeneous alloy formation. Electron probe microanalysis (EPMA) gave a 3:1 ratio of Cu:Ni in the alloy, indicating that the stoichiometry of the precursor was preserved in the product. Furthermore, the alloy produced from the Cu-Ni complex showed significantly different morphology from that of the metal chloride and metal nitrate reduction products.

A SEM micrograph showed that the reduction of the complex (precursor 3) resulted in the formation of uniform, regular particles about 1 to 2 μm (micrometers) in size, whereas the nitrate and chloride precursors resulted in larger, more irregularly shaped particles ranging in size from 10 to 500 μm. This is of interest in catalysis where it is desirable to have a Cu-Ni alloy catalyst which is formed at low temperature (and therefore high surface area), single phase, homogeneous on a microscopic scale and of uniform particle size.

In summary, applicants have determined that two conditions favored the facile, low-temperature formation of Cu-Ni alloys. First, the decomposition temperature of the precursor should be above the critical temperature for the single-phase alloy formation. Second, chemical homogeneity of copper and nickel on a molecular level in the precursor facilitates single-phase alloy formation and chemical homogeneity in the reduction product.

A wide variety of polyheterometallic complexes have been made by transmetallation. The reactions are quantitative under mild conditions, and the products are simple and easily separated. The method disclosed herein suggests the use of such complexes as low-temperature precursors for facile alloy formation in a variety of metal systems.

It will now be apparent to those skilled in the art that other embodiments, improvements, details and uses can be made consistent with the letter and spirit of the foregoing disclosure and within the scope of the patent, which is limited only by the following claims, construed in accordance with patent law, including the doctrine of equivalents.

What is claimed is:

1. A method of making single-phase and homogeneous metal alloys of large surface area at low temperature comprising the steps of:

(a) subjecting a polyheterometallic complex which includes the metals copper and nickel and being formed by transmetallation to a hydrogen-containing gas;

(b) heating said polyheterometallic complex to a temperature equal to or above its decomposition temperature;

(c) and maintaining said temperature for a time sufficient to reduce said complex to a single-phase alloy.

2. The method defined in claim 1 wherein the atomic ratio of copper to nickel in said polyheterometallic complex is three to one.

3. The method defined in claim 2 wherein said polyheterometallic complex has the chemical formula:

$$(\mu_4-0)N_4Cu_3NiCl_6.H_2O$$

where N is N,N-diethylnicotinamide.

4. The method of claim 3 wherein said polyheterometallic complex is heated to a temperature of about 370 degrees centigrade.

* * * * *

UNITED STATES PATENT AND TRADEMARK OFFICE

CERTIFICATE OF CORRECTION

PATENT NO. : 4,933,003

DATED : June 12, 1990

INVENTOR(S) : James V. Marzik

It is certified that error appears in the above-identified patent and that said Letters Patent is hereby corrected as shown below:

Column 1, line 20, "Gu-Ni" should read --Cu-Ni--.

Column 2, line 18, "extend" should read --extent--.

Column 2, line 25, "Tractor" should read --Tracor--.

Signed and Sealed this

Twentieth Day of July, 1993

*Attest:*

*Attesting Officer*

Michael K. Kirk

MICHAEL K. KIRK

*Acting Commissioner of Patents and Trademarks*